United States Patent [19]

Olsen

[11] Patent Number: 4,531,109

[45] Date of Patent: Jul. 23, 1985

[54] TUNING COIL STRUCTURE

[75] Inventor: Perry C. Olsen, Noblesville, Ind.

[73] Assignee: RCA Corporation, Princeton, N.J.

[21] Appl. No.: 479,448

[22] Filed: Mar. 28, 1983

[51] Int. Cl.[3] ..... H01F 21/08

[52] U.S. Cl. ..... 336/87; 336/84 C

[58] Field of Search ..... 336/84 C, 87, 196, 198, 336/199, 208

[56] References Cited

U.S. PATENT DOCUMENTS

| | | | |
|---|---|---|---|
| 2,748,357 | 5/1956 | Garcia | 336/87 X |
| 3,092,796 | 6/1963 | Maeda | 336/87 X |
| 3,278,877 | 10/1966 | Kameya et al. | 336/84 C X |
| 3,312,919 | 4/1967 | Ross | 336/84 |
| 3,432,785 | 3/1969 | Solmos | 336/198 |
| 3,461,413 | 8/1969 | Randolph et al. | 336/84 |
| 3,517,361 | 6/1970 | Reifel et al. | 336/84 |
| 3,521,210 | 7/1970 | Iwata et al. | 336/87 |

OTHER PUBLICATIONS

Thorpe, "Arcsprayed Metal Coating for EMI/RFI Shielding", Microwave Journal, May 1981, pp. 133–138.

Dreger, "Shielding of Electronics with Conductive Plastics", Machine Design, Jan. 6, 1983, pp. 79–85.

*Primary Examiner*—Reinhard J. Eisenzopf

*Attorney, Agent, or Firm*—Paul J. Rasmussen; Peter M. Emanuel; Scott J. Stevens

[57] ABSTRACT

A tuning coil assembly includes an adjustable coil wound on a bobbin around which is placed a plastic coil support sleeve. The sleeve provides protection for the coil and aids in adjustment of a tuning slug inside the coil by an automatic alignment fixture. The plastic coil support sleeve is coated with a thin metallic layer or alternately impregnated with metallic particles to provide electromagnetic radiation shielding for the coil. The combination of the sleeve for both coil adjustment and electrical shielding permits placement of the coil assembly on a smaller area of a circuit board than would be possible with a separate metal shield can.

14 Claims, 3 Drawing Figures

TUNING COIL STRUCTURE

Figure 1:
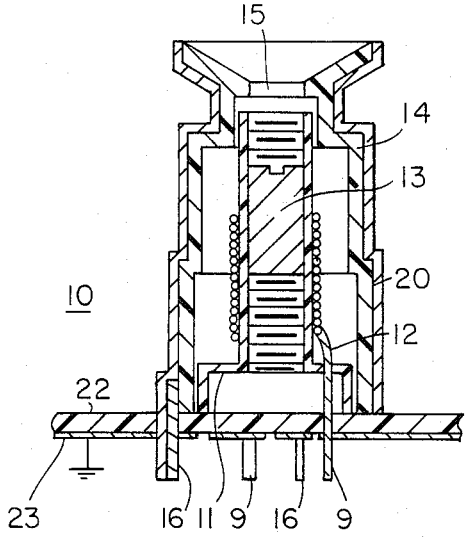

This invention relates to high frequency signal shielding such as is used for television receiver components and, in particular, to a shield assembly having reduced size and cost.

High frequency tuning coils, such as those used in video and audio intermediate frequency amplifiers for television receivers, require shielding from external signals which alter the electromagnetic fields and therefore the tuning of the coils. It is known to shield a coil by placing a thin metallic box or can around the coil. The box or can, connected to signal ground potential, presents a much lower reluctance path for the external electromagnetic fields than air, causing the unwanted external fields to be shunted to ground.

Shield structures of the known type are typically made large relative to the coil being shielded, so that the coil does not accidentally come into contact with the grounded shield structure. As a result, such shield structures require a relatively large amount of mounting area on an electrical circuit board. Small screen television receivers have correspondingly small cabinets, which limits the size of the circuit boards that may be used. Circuit board area must be allocated wisely, and large shield structures such as those previously described are therefore undesirable.

Typically, coils used in intermediate frequency (IF) amplifier stages need to be aligned to properly define the frequency response of the IF stage. This is commonly done by adjusting the position of a magnetically permeable slug which is located within the tuning coil winding frame or bobbin. The slug and bobbin are threaded so that rotation of the slug causes its longitudinal position within the bobbin and surrounding coil to change. This may be done by automatic alignment equipment which automatically rotates the slug until a desired tuning condition is attained. When automatic alignment equipment is used, a plastic sleeve may be used to surround the coil in order to provide mechanical protection and support for the alignment tool. Typically, the top of the sleeve includes a funnel-type entrance for the alignment tool which aids in guiding the alignment tool into proper position. Use of this sleeve increases the size of the coil structure and may require an increase in the size of the surrounding metal shield structure.

The present invention is directed to an arrangement for providing electromagnetic interference shielding for tuning coils that is reduced in size and cost with respect to the commonly used metal cap.

In accordance with the present invention, a tuning coil assembly comprises a bobbin on which is wound a plurality of wire turns forming a coil. A rigid nonmetallic coil support sleeve surrounds the coil and bobbin and generally conforms to its shape. The sleeve may include a funnel-type entrance for an alignment tool. Terminal members for insertion into a circuit board are attached to the coil alignment sleeve. A thin metallic coating is formed on the outer surfaces of the sleeve to provide electromagnetic shielding for the coil, the coating also overcoating the terminal members.

Figure 2:
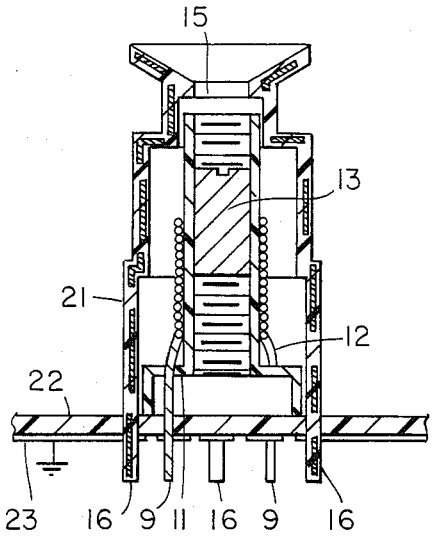
Figure 1A:
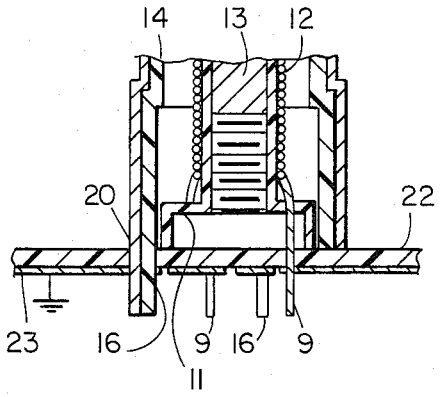

In the accompanying drawing, FIG. 1 is a cross-sectional elevational view of a tuning coil assembly constructed in accordance with the present invention;

FIG. 1A is a cross-sectional elevational view of a portion of the coil assembly of FIG. 1, illustrating an alternate embodiment; and FIG. 2 is a cross-sectional elevational view of another embodiment of the tuning coil assembly of the present invention.

Referring to FIG. 1, there is shown a tuning coil assembly 10 comprising a bobbin 11, on which is wound a coil 12 comprising a plurality of wire turns. Bobbin 11 is illustratively shown as cylindrical, but may be of other shapes, such as square. The coil terminal ends may be soldered to circuit board terminals 9 and thereby to a utilization circuit. A magnetically permeable slug 13 is shown disposed within bobbin 11. Slug 13 and the cylindrical inner wall of bobbin 11 are correspondingly threaded so that rotational movement of slug 13 longitudinally positions it with respect to coil 12 and thereby determines the inductance of coil 12. The resonant frequency of the circuit to which coil assembly 10 is connected is thereby adjusted.

A rigid plastic coil support sleeve 14 is disposed around coil 12 and bobbin 11. Coil support sleeve 14, having a shape which allows it to be closely spaced or conform to coil 12 and bobbin 11, provides mechanical protection and support for coil 12. In order to cooperate with an adjustment tool of an automatic alignment machine, sleeve 14 comprises a funnel-type entrance arrangement 15 having a central aperture to allow access to the adjustable slug 13 by an alignment machine tool, such as a screwdriver. Funnel-type arrangement 15 guides the alignment machine tool into the aperture in the event the tool is slightly displaced with respect to the slug 13.

In accordance with the present invention, a thin metallic coating 20 is deposited or formed on sleeve 14, thereby creating an electromagnetic interference shield structure for coil 12.

To provide effective electromagnetic field shielding of coil 12, the conductive coating 20 on coil support sleeve 14 must be connected to ground potential. For this purpose, circuit board 22 has a conductive surface 23 connected to ground potential. In order to provide connection between coating 20 on coil support sleeve 14 and ground potential surface 23 on circuit board 22, coil support sleeve 14 incorporates terminal members 16 which, as shown in FIG. 1, may comprise metal legs driven or embedded into the plastic of sleeve 14. In order that good electrical contact is made between terminal members 16 and conductive coating 20, coating 20 is applied continuously over sleeve 14 and terminal members 16, essentially overcoating terminal members 16.

FIG. 1A illustrates an alternate embodiment in which terminal members 16 are formed as a part of a nonconductive coil support sleeve 14 and are coated by conductive coating 20 along with the rest of sleeve 14. The use of high temperature plastics, such as polysulfone or polyetherimide, for example, permits connection to conductive surface 23 by soldering directly to the conductive coating 20 on terminal members 16 of sleeve 14.

For illustrative purposes, metallic coating 20 may comprise a first layer of copper having a thickness in the range of 0.2–0.5 mils and a second thin layer of nickel, commonly referred to as a flash layer, having a thickness in the range of 0.005–0.01 mils. These metals may be plated onto the surface of sleeve 14 by dipping sleeve 14 into solutions of appropriate concentrations of the desired metals for predetermined periods of time. It is also possible to coat sleeve 14 via vacuum deposition techniques, in which the metal is vaporized in a vacuum and deposited onto an electrically charged sleeve 14.

FIG. 2 illustrates an alternate embodiment of the coil assembly 10 in which a coil support sleeve 21 is formed of an electrically conductive plastic, comprising a conventional plastic substrate, such as polypropylene, which incorporates metallic fibers or flakes. These fibers or flakes may be aluminum, carbon or stainless steel, for example. A structure of this type would not require a metallic coating in order to provide electromagnetic radiation shielding.

It may be possible, by controlling the choice of plating materials or their thicknesses, or by controlling the type or concentration of conductive fibers in a conductive plastic structure for coil alignment sleeve 14 or 21, to vary the conductivity of the shielding structure and hence vary the effective load resistance of the tuning coil. This would in turn vary the Q or selectivity of the associated resonant circuit. This may aid in designing tuning or amplifier circuits and may eliminate the need for a separate selectivity-determining load resistor that would otherwise be required.

What is claimed is:

1. A tuning coil assembly comprising:

a bobbin incorporating coil adjustment means;

a plurality of wire turns wound on said bobbin to form a coil;

a rigid nonmetallic coil support sleeve surrounding said coil and bobbin, a portion of said coil support sleeve conformed closely to said bobbin such that the transverse position of said bobbin is fixed within said support sleeve to aid in adjusting said coil adjustment means;

terminal members for insertion into an electrical circuit board attached to said nonmetallic coil support sleeve; and a thin metallic coating, deposited on the outer surface of said nonmetallic coil support sleeve and conforming thereto to provide electrical shielding for said coil from external electromagnetic fields, said coating being electrically connected to said terminal members for providing electrical contact with said circuit board.

2. The arrangement defined in claim 1, wherein said terminal members comprise metallic posts fixedly mounted to said coil support sleeve.

3. The arrangement defined in claim 2, wherein said metallic coating overcoats said sleeve and said terminal members.

4. The arrangement defined in claim 1, wherein said terminal members comprise nonmetallic posts, formed as a part of said coil support sleeve.

5. The arrangement defined in claim 4, wherein said metallic coating overcoats said sleeve and said terminal members.

6. The arrangement defined in claim 1, wherein said coil support sleeve is formed of plastic.

7. The arrangement defined in claim 1, wherein an adjustable magnetically permeable slug is located within said bobbin.

8. The arrangement defined in claim 1, wherein said metallic coating comprises metallic layers of copper and nickel.

9. The arrangement defined in claim 8, wherein said metallic coating of copper has a thickness in the range of 0.2 mils to 0.5 mils and said metallic coating of nickel has a thickness in the range of 0.005 mils to 0.01 mils.

10. The arrangement defined in claim 1, wherein said coil support sleeve comprises an opening permitting the insertion of a coil adjusting tool.

11. The arrangement defined in claim 10, wherein said opening is a funnel-type entrance.

12. The arrangement defined in claim 1, wherein the conductivity of said metallic coating adjusts the effective load resistance of said coil.

13. A tuning coil assembly comprising:

a bobbin incorporating coil adjustment means;

a plurality of wire turns wound on said bobbin to form a coil having a plurality of wire terminal ends;

electrical terminals coupled to said wire terminal ends;

a rigid nonmetallic electrically conductive coil support sleeve impregnated with metallic particles so as to be electrically conductive, said coil support sleeves surrounding said coil and bobbin and having a portion conformed closely thereto for fixing the transverse position of said bobbin within said coil support sleeve to aid in adjusting said coil adjustment means; and terminal members for insertion into an electrical circuit board electrically connected to said coil support sleeve.

14. The arrangement defined in claim 13, wherein said coil support sleeve comprises electrically conductive plastic.

* * * * *